United States Patent [19]

Craig

[11] Patent Number: 4,890,831

[45] Date of Patent: Jan. 2, 1990

[54] BARBELL EXERCISING DEVICE

[76] Inventor: Richard D. Craig, 56 64½ S. Ninth, Kalamazoo, Mich. 49009

[21] Appl. No.: 215,376

[22] Filed: Jul. 5, 1988

[51] Int. Cl.[4] ..... A63B 13/00

[52] U.S. Cl. ..... 272/123

[58] Field of Search ..... 272/93, 117, 119, 122, 272/123, 143; 248/340, 364

[56] References Cited

U.S. PATENT DOCUMENTS

| | | | |
|---|---|---|---|
| 2,470,815 | 5/1949 | Harvey | 272/123 |
| 4,226,414 | 10/1980 | Coffaro et al. | 272/117 |
| 4,360,198 | 11/1982 | Waulters | 272/117 |
| 4,482,151 | 11/1984 | Zwilling | 272/123 |
| 4,635,930 | 1/1987 | Cormier | 272/123 |
| 4,676,465 | 6/1987 | Myotte | 248/340 X |
| 4,711,449 | 12/1987 | Ochab | 272/123 |

FOREIGN PATENT DOCUMENTS

| | | | |
|---|---|---|---|
| 1330826 | 5/1962 | France | 248/340 |

*Primary Examiner*—Richard J. Apley
*Assistant Examiner*—Robert W. Bahr
*Attorney, Agent, or Firm*—Gifford, Groh, Sheridan, Sprinkle and Dolgoruko

[57] ABSTRACT

An exercising device for a barbell which increases the weight of the barbell during a first eccentric movement and decreases the total weight of the barbell during concentric movement. The exercising device includes a vertically elongated stand having a flat base at its lower end and a hook at its upper end. The hook is pivotal between a first position in which the hook extends around and attaches the stand to end of the barbell, and a second position in which the hook pivots away from the barbell and detaches the stand from the barbell. A weight urges the hook towards its second position so that the hook automatically moves to its second position when the base engages the ground surface. Weights are selectively added to the base to increase the overall weight of the barbell during eccentric movement as desired.

5 Claims, 1 Drawing Sheet

BARBELL EXERCISING DEVICE

BACKGROUND OF THE INVENTION

1. Field of the Invention

The present invention relates generally to athletic equipment and, more particularly, to an exercising device for a barbell.

2. Description of the Prior Art

In one type of speed weight lifting exercise, a barbell is moved by the weight lifter during a single downward and return upward movement. The downward movement is known as eccentric movement while the upward movement is known as concentric movement.

It is well kown that the muscles of the human body are capable of lifting between twenty and fifty percent more weight during eccentric movement than during concentric movement. Thus, for maximum exercising efficiency, the weight on the barbell should be between twenty and fifty percent greater during eccentric movement than during concentric movement.

In the previously known barbells the weight of the barbell, while adjustable between different exercises or exercise routines, is fixed during any particular exercise routine. Consequently, it is not possible to obtain maximum exercising efficiency since either the preferred weight for eccentric movement is too small, the preferred weight for concentric movement is too large, or both.

SUMMARY OF THE PRESENT INVENTION

The present invention provides an exercising device for a barbell which overcomes the above mentioned disadvantages of the previously known barbells.

In brief, the present invention comprises a pair of vertically elongated stands which are substantially identical to each other. Each stand has a flat base secured transversely across its lower end and weights are selectively added by the weight lifter on top of the base to increase the weight of the stand.

A hook is pivotally secured to the top of the stand and is pivotal between a first position and a second position. In its first position the hook extends over and attaches the stand to the barbell. Conversely, in its second position the hook pivots away from the barbell and detaches the stand from the barbell. A weight on the hook urges the hook towards its second or detached position.

In practice, with the barbell elevated in a bench press stand or the like, one stand is attached to each end of the barbell by moving the hook to its first position and placing the hook over the barbell. With the stands attached to the barbell in this fashion, the base of each stand is spaced upwardly from the floor so that the stands depend downwardly from the barbell.

The barbell with the attached stands is then moved downwardly through eccentric movement by the weight lifter until the bases of the stand engage the floor. When this happens, the hooks pivot to their second position and detach the stands from the barbell. The weight lifter then lifts the barbell upwardly through concentric movement to the bench press stand and the exercise routine is completed.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PREFERRED INVENTION

Figure 1:
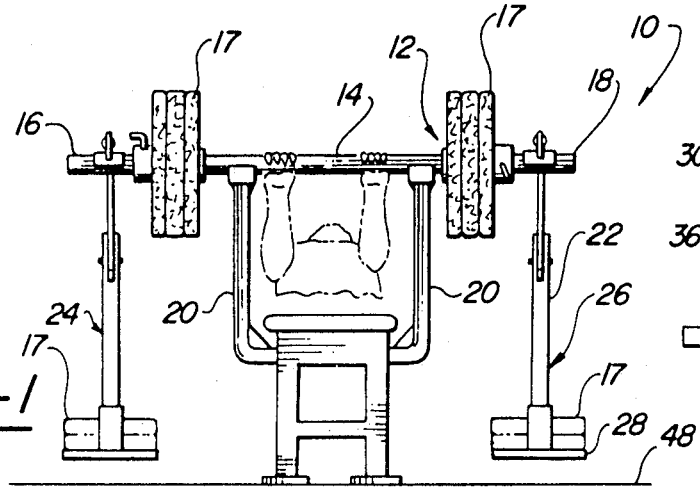
FIG. 1 is a side view illustrating a preferred embodiment of the present invention.

With reference first to FIG. 1, a preferred embodiment of the exercising device 10 of the present invention is thereshown for use with a barbell 12. The barbell 12 is conventional in construction and comprises an elongated bar 14 having two ends 16 and 18. Disc shaped weights 17 are secured to the barbell 12 adjacent each end 16 and 18 and the entire barbell 12 is supported in an elevated horizontal position by two bench press supports 20.

The exercising device 10 comprises a pair of stands 22 and 24 which are substantially identical to each other. Consequently, only one stand 22 will be described in detail, it being understood that a like description shall also apply to the other stand 24.

Still referring to FIG. 1, the stand 22 includes a vertically elongated shaft 26 having a flat, disc shaped base 28 secured transversely across its lower end. The base 28 is dimensioned to support one or more weights 17 on its top. The total weight of the stand 22 will vary depending of the number and type of weights placed by the weight lifter on the base 28.

Figure 8:
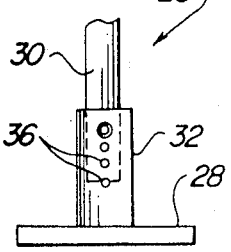
FIG. 8 is a fragmentary side view illustrating a further portion of the preferred embodiment of the present invention.

With reference now to FIGS. 1 and 8, the shaft 26 preferably is constructed from an elongated rod 30 which is telescopically received within a tube 32 attached to the base 28. A pin 34 extends through registering holes in the rod 30 and tube 32 to detachably secure the rod 30 and tube 32 together. With the rod 30 and tube 32 detached from each other, the weight lifter can add weights 17 from the base 28 by placing the weights over the tube 32 and vice versa. In addition the tube 32 preferably has a plurality of longitudinally spaced holes 36 to enable adjustment of the vertical length of the shaft 26 and thus of the stand 22.

Figure 5:
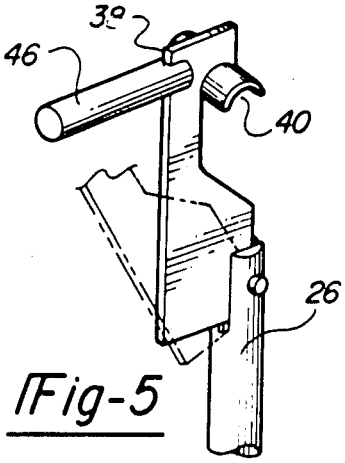
FIGS. 5–7 are fragmentary side views illustrating the operation of the hook in the embodiment of the present invention.
Figure 6:
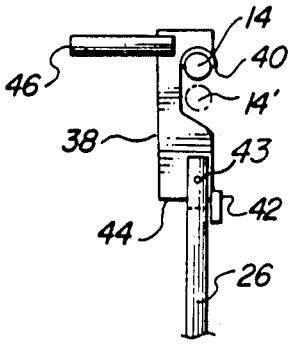
Figure 7:
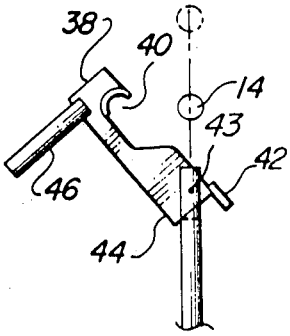

With reference now to FIGS. 5–7, a hook 38 having an opening 40 is pivotally mounted to a slot in the top of the shaft 26 by a pivot pin 43. The hook 38 is pivotal between a first position, shown in FIG. 6, and a second position, shown in FIG. 7. A pair of stops 42 and 44 on the hook 38 respectively abut against the shaft 26 in its first and second positions to limit the pivotal movement of the hook 38 between the positions shown in FIGS. 6 and 7.

A weight 46 is secured to and extends horizontally outwardly from one side of the hook 38. The weight 46, which also forms a handle for the stand 22, urges the hook 38 towards its second position.

Figure 2:
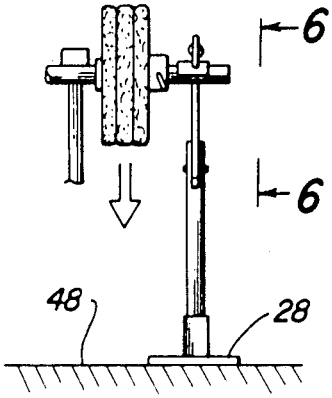
FIGS. 2–4 are fragmentary side views illustrating the operation of the embodiment of the present invention.

As best shown in FIGS. 1, 2 and 6, with the hook 38 in its first position the hook 38 extends over the end 18 of the barbell bar 14 and attaches the stand 22 to the barbell 12. In doing so, the stand 22 depends downwardly from the barbell 12 so that the base 28 is spaced upwardly from the floor 48.

Figure 3:
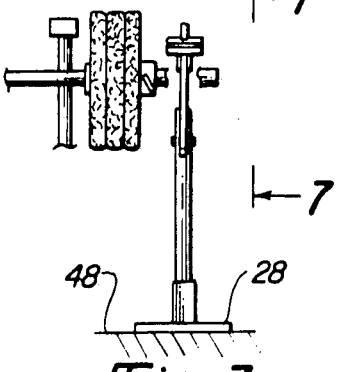
Figure 4:
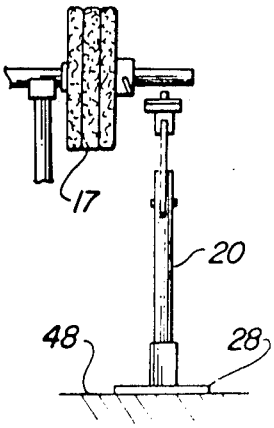

The weight lifter then moves the barbell 12 with the attached stands 22 and 24 downwardly through eccentric movement to the position shown in FIGS. 3 and 6 in which the base 28 engages the floor 48. Upon continued downward movement of the barbell 12, the bar 14 of the barbell 12 moves to the position shown at 14' in phantom line in FIG. 6 and thus into the opening 40 of the hook 38. When this occurs, the weight 46 pivots the hook 38 to its second position shown in FIGS. 4 and 7 thereby detaching the stands 22 and 24 from the barbell 12. Thereafter, the barbell 12 is moved upwardly through concentric movement to the elevated position shown in FIG. 1 and placed upon the bench press supports 20 by the weight lifter.

From the foregoing it can be seen that the present invention provides a simple, inexpensive and yet totally effective device which increases the weight of the barbell during eccentric movement and decreases the weight during concentric movement. The device of the present invention is particularly well suited for speed lifting.

Having described my invention, many modifications thereto will become apparent to those skilled in the art to which it pertains without deviation from the spirit of the invention as defined by the scope of the appended claims.

I claim:

1. A device for use with a barbell comprising:

an elongated stand having an upper end and a lower end, means at the upper end of the stand for attaching said stand to the barbell, means for disengaging said attaching means from said barbell as said lower end of the stand engages and is supported by a ground support surface, said attaching means comprising a hook, means for pivotally securing said hook to said upper end of said stand so that said hook is pivotal between a first position in which said hook extends around said barbell and a second position in which said hook pivots away and disengages from said barbell, and means for urging said hook towards said second position, wherein said urging means comprises a weighted handle secured to and extending outwardly from said hook.

2. The invention as defined in claim 1 and comprising means for attaching user selected weights to the lower end of said stand.

3. The invention as defined in claim 1 wherein said means at the upper end of the stand for attaching said stand to the barbell includes a hook means and wherein said stand comprises an elongated and substantially vertical shaft, a flat base at a lower end of said shaft and wherein said hook means is disposed at the upper end of said shaft.

4. The invention as defined in claim 3 and comprising means for varying the length of said shaft.

5. The invention as defined in claim 4 wherein said shaft comprises a rod telescopically received in a tube, and wherein said varying means comprises means for locking said rod and said tube together at an adjusted telescopic position.

* * * * *